US006871840B2

(12) United States Patent
Peterson

(10) Patent No.: US 6,871,840 B2
(45) Date of Patent: Mar. 29, 2005

(54) SYSTEM AND METHOD FOR MOTION COMPENSATION UTILIZING AN UNDERWATER SENSOR

(75) Inventor: John F. Peterson, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 58 days.

(21) Appl. No.: 10/263,856

(22) Filed: Oct. 3, 2002

(65) Prior Publication Data

US 2004/0065873 A1 Apr. 8, 2004

(51) Int. Cl.[7] ..... B66D 1/48
(52) U.S. Cl. ..... 254/268; 254/269
(58) Field of Search ..... 254/267, 268, 254/275, 269

(56) References Cited

U.S. PATENT DOCUMENTS

| | | | | | |
|---|---|---|---|---|---|
| 4,577,693 | A | | 3/1986 | Graser | |
| 5,335,620 | A | * | 8/1994 | Small | 114/243 |
| 5,439,800 | A | | 8/1995 | Thompson | |
| 5,507,596 | A | | 4/1996 | Bostelman et al. | |
| 5,581,930 | A | * | 12/1996 | Langer | 43/17 |
| 5,696,738 | A | * | 12/1997 | Lazauski | 367/188 |
| 5,816,874 | A | * | 10/1998 | Juran et al. | 441/1 |
| 5,859,812 | A | * | 1/1999 | Sullivan et al. | 367/130 |
| 6,000,362 | A | * | 12/1999 | Blyth et al. | 119/51.04 |
| 6,002,644 | A | * | 12/1999 | Wilk | 367/88 |
| 6,046,963 | A | * | 4/2000 | Glenning | 367/188 |
| 6,234,717 | B1 | | 5/2001 | Corbetta | |
| 6,376,831 | B1 | * | 4/2002 | Nguyen | 250/227.21 |
| 6,443,098 | B1 | * | 9/2002 | Blyth et al. | 119/230 |
| 6,472,983 | B1 | * | 10/2002 | Grunder | 340/540 |
| 6,606,958 | B1 | * | 8/2003 | Bouyoucos | 114/242 |
| 2001/0010782 | A1 | | 8/2001 | Corbetta | |
| 2002/0023755 | A1 | | 2/2002 | McGarin | |

FOREIGN PATENT DOCUMENTS

| | | | | | |
|---|---|---|---|---|---|
| JP | 401153988 | A | * | 6/1989 | 367/188 |
| JP | 411079079 | A | * | 3/1999 | 367/188 |

* cited by examiner

*Primary Examiner*—Emmanuel Marcelo
(74) *Attorney, Agent, or Firm*—Duane Morris LLP

(57) ABSTRACT

A system and method of use for determining a desired physical parameter relating to a load deployed by a movable vessel, in a predetermined plane, using a sensor disposed proximate the load underwater where the sensor produces a transmittable signal indicative of the desired physical parameter and communicates the signal, via a communication link, to a receiver that receives and indicates the pressure signal. A deployment frame may be used to further support the load. Once deployed, the load encounters water having changes in the detected physical parameter and the sensor sends a signal indicative of the changes such as to a controller or computer located on a movable vessel. These signals can be used to determine movement and positioning of the load, e.g. when positioning the load proximate an underwater structure. It is emphasized that this abstract is provided to comply with the rules requiring an abstract which will allow a searcher or other reader to quickly ascertain the subject matter of the technical disclosure. It is submitted with the understanding that it will not be used to interpret or limit the scope of meaning of the claims.

20 Claims, 2 Drawing Sheets

SYSTEM AND METHOD FOR MOTION COMPENSATION UTILIZING AN UNDERWATER SENSOR

FIELD OF THE INVENTION

The present invention relates to use of a sensor for positioning of a load during deployment of the load underwater.

BACKGROUND OF THE INVENTION

Precise measurements relative to a load being deployed underwater, e.g. vertical displacement from a reference point, are important to the safety, cost, and effectiveness of deploying the load. This is especially true with gauging vertical position relative to an underwater work site at which the load is to be deployed, e.g. a seafloor or an underwater structure.

Systems currently use sensors located at a surface location, e.g. on a vessel, which may induce erroneous feed signals. Moreover, surface systems are adversely affected, e.g. by surface motion, when attempting to safely deploy and/or land heavy loads at an underwater structure from a vessel.

Further, numerous systems providing vertical measurement and feedback are typically complex and costly.

BRIEF DESCRIPTION OF THE DRAWINGS

The features, aspects, and advantages of the present invention will become more fully apparent from the following description, appended claims, and accompanying drawings in which:

DETAILED DESCRIPTION OF AN EXEMPLARY EMBODIMENT

Figure 1:
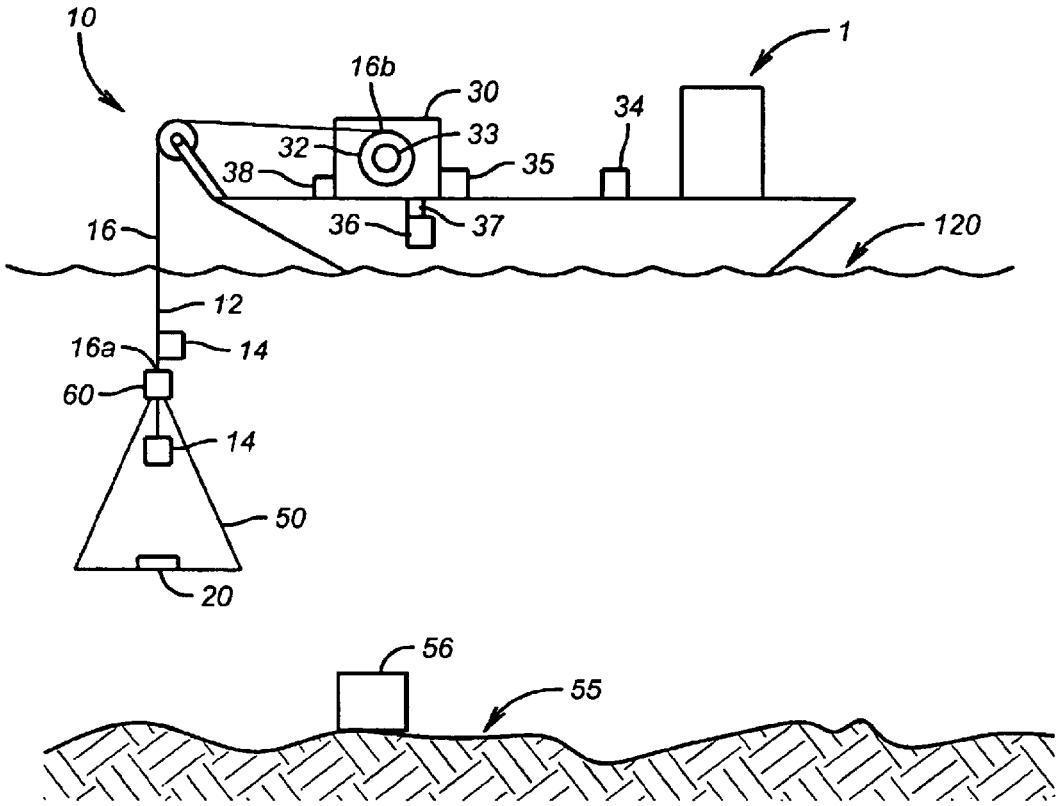
FIG. 1 is a schematic of an exemplary system.

Referring to FIG. 1, system 10 for controlling the placement of load 20 deployed by movable vessel 1 onto or proximate an underwater structure such as underwater floor 55 or proximate underwater structure 56 comprises sensor 14 disposed about load 20; controllable winch 30; controller 35, operable to control controllable winch 30; and communication link 16 operatively connected to sensor 14 and controller 35 such that a signal generated by sensor 14 is communicated via communication link 16 to controller 35. As used herein, "underwater" comprises oceans, seas, fresh water bodies such as lakes or rivers, and the like.

Load 20 may be a load desired to be placed or otherwise positioned underwater and may range in weight from a few pounds to tens of thousands of pounds, as long as load 20 can be safely supported and deployed using communication link 16, either alone or in conjunction with a companion cable. Although shown disposed about deployment frame 50 in FIG. 1, as discussed herein below load 20 may be disposed about end 16*a* of communication link 16 such as using load bearing connection device 60 without the use of deployment frame 50.

Sensor 14 is disposed proximate load 20, e.g. at a predetermined offset from load bearing connection device 60, which may be above, below, or at load bearing connection device 60. Sensor 14 is capable of generating a communicable signal representative of a predetermined physical parameter, e.g. pressure of surrounding water or sonar reflection off an object, which can be calculated and translated into a useful measure. For example, the physical parameter may be water pressure and the useful measure may be distance from vessel 1 or underwater structure 55,56 in a vertical plane relative to vessel 1 or underwater structure 55,56. In a further example, the physical parameter may be movement of load 20 in a predetermined plane such as a vertical plane relative to underwater structure 55,56 and/or vessel 1.

In a preferred embodiment, the communicable signal is electrical but may be optical, acoustic, or the like, or combinations thereof.

In a currently preferred embodiment, sensor 14 is a pressure transducer such as exemplified by the Digiquartz® Depth Sensors manufactured by Paroscientific, Inc. of Redmond, Wash. In a currently envisioned alternative embodiment, an altimeter may be used for sensor 14. Whereas a pressure transducer measures water pressure which may be translated into a distance from a surface such as underwater structure 55,56, an altimeter may be used to measure distance between load 20 and underwater structure 55,56, such as in a vertical plane relative to vessel 1 or underwater structure 55,56. Suitable altimeters are the Datasonics PSA-900 series of programmable sonar altimeters manufactured by Benthos, Inc. of North Falmouth, Mass.

In further embodiments, other sensors may be employed, e.g. sonar, optical, or Doppler sensors.

In a preferred embodiment, communication link 16 is capable of supporting load 20 during deployment of load 20 underwater. Communication link 16 may be an electromechanical umbilical, e.g. an armored umbilical capable of supporting load 20 while also being used for data transmission.

Figure 2:
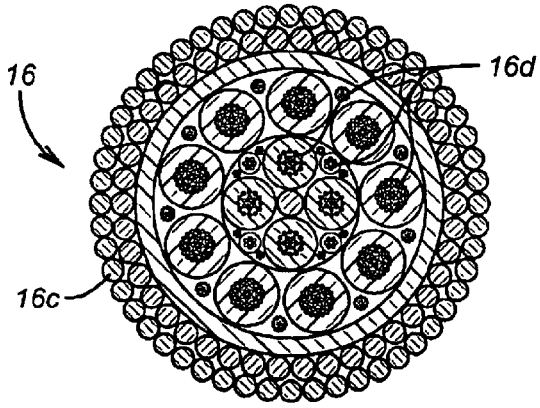
FIG. 2 is a cross-sectional view of an exemplary armored cable.

Referring to FIG. 2, in a compound umbilical configuration communication link 16 may have one or more outer armored layers 16*c* and one or more inner cables, 16*d*, e.g. electrical and/or optical cables. Inner cables 16*d* may further comprise one or more inner cables 16*d* capable of conducting a signal from sensor 14. Accordingly, communication link 16 may be a single cable such umbilical or a compound umbilical comprising both a load supporting member, e.g. 16*c*, and a data transmission supporting member, e.g. 16*d*.

Referring back to FIG. 1, communication link 16 is operatively in communication with sensor 14 and may be used to transmit data representative of a detected physical parameter, e.g. water pressure, from sensor 14 to a receiver, e.g. controller 35. In an alternative embodiment, if acoustic signaling is employed, communication link 16 may be separate from a cable used to deploy load 20, e.g., water, other structures such as tubulars, and the like.

Controllable winch 30 may further comprise rotatable winch drum 32 and winch slip ring assembly 33 operatively connected to rotatable winch drum 32 providing signal transmission from a stationary to a rotary medium Controller 35 may further comprise a receiver such as computer 36 and manual controls 38 operatively connected to controllable winch 30 and capable of translating the signal generated by sensor 14 into a control signal for controlling controllable winch 30. In alternative embodiments, receiver 37 may be computer 36, integral with computer 36, or a separate unit comprising a digital or analog readout useful to convert the signal received from sensor 14 into a visible format. Additionally, receiver 37 may convert the signal received from sensor 14 into a machine perceptible format such as a digital signal such as for use by computer 36 or controller 35, an audibly detectable indicator, a tactily detectable indicator, or the like, or a combination thereof.

System 10 may be adapted to operate with different electric or electro-hydraulic winches 30.

Additionally, in certain embodiments, deployment frame 50 may be present where deployment frame 50 is capable of supporting load 20 when load 20 and deployment frame 50 are deployed underwater. Deployment frame 50 may be a cage, a frame, a platform, a connector, or the like, or combinations thereof.

It will be understood by those of ordinary skill in the art that a mechanical termination assembly (not shown in the figures) may be installed on end 16*a* of communication link 16 to allow attachment of one or more devices, e.g. load 20 or deployment frame 50, to communications link 16.

Figure 3:
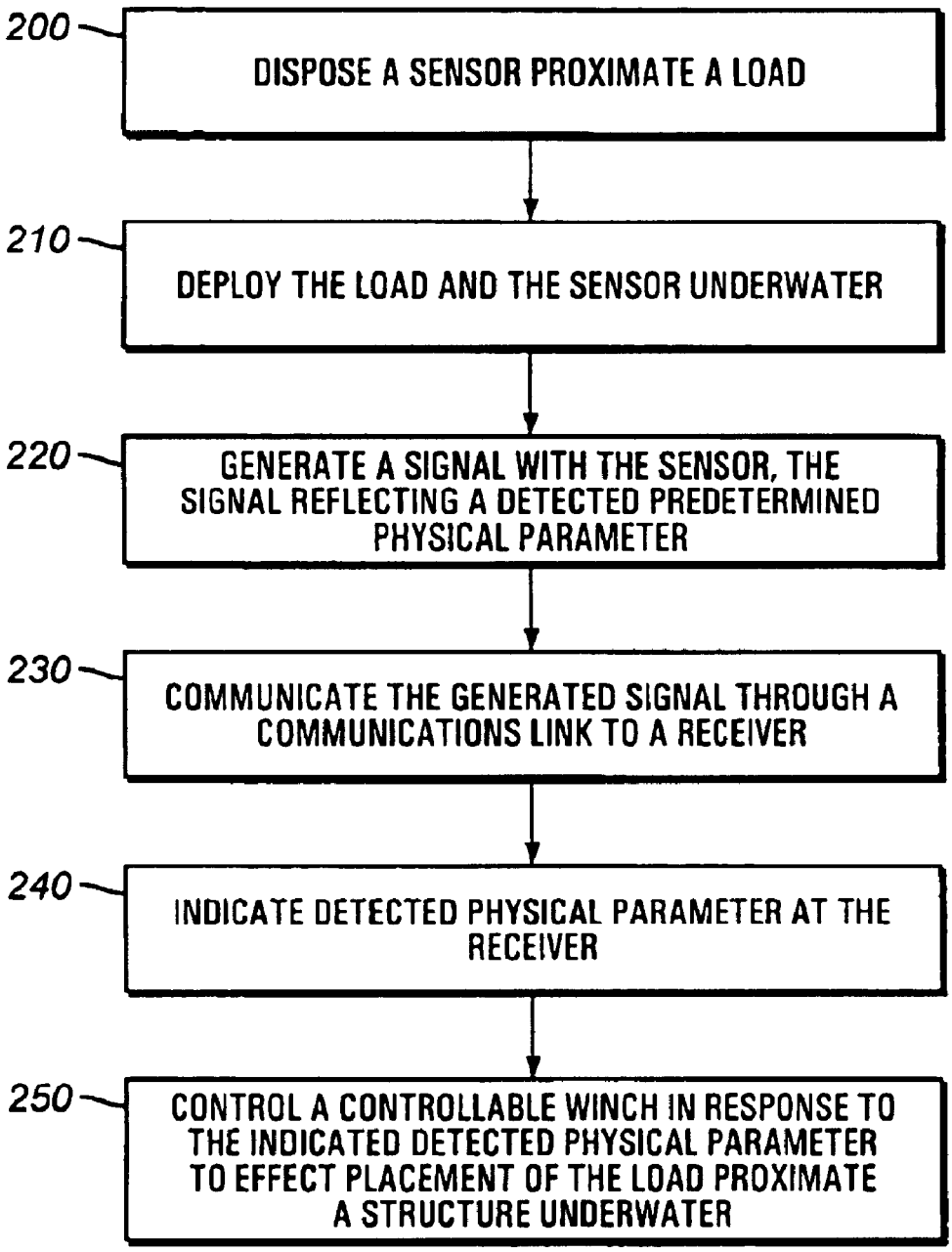
FIG. 3 is a flowchart of an exemplary method of the present invention.

In the operation of an exemplary embodiment, referring now to FIG. 3, load 20 is to be deployed by movable vessel 1 onto or proximate underwater structure 55,56. Load 20 is first disposed, step 200, about communication link 16 or, in an alternative embodiment, deployment frame 50. Load 20 may be secured to communication link 16 such as by using a load bearing connection device 60, e.g. a snap hook, a shackle, or the like, or by use of deployment frame 50, or the like.

In a preferred embodiment, load 20 is disposed about communication link 16 by connecting load 20 to first end 16*a* of communication link 16 using load bearing connection device 60 where communication link 16, first end 16*a*, and load bearing connection device 60 are capable of supporting a load created by load 20 during deployment of load 20, e.g. underwater.

Sensor 14 is deployed proximate load 20 and can be disposed at or near load 20 or load bearing connection device 60. Sensor 14 may be positioned where it can be recovered with communication link 16.

In an alternative embodiment, if load 20 is disposed about deployment frame 50, deployment frame 50 is connected, step 210, to first end 16*a* of communication link 16 where communication link 16 and first end 16*a* are capable of supporting a load created by load 20 during deployment of load 20, e.g. underwater.

Second end 16*b* of communication link 16 is operatively connected, step 220, to controller 35 disposed about movable vessel 1.

Load 20 is then deployed, step 230, from movable vessel 1 into a body of water, e.g. ocean 120.

When load 20 is deployed into the body of water, sensor 14 generates a signal, step 240, indicative of predetermined physical parameter such as underwater pressure. The generated signal is sent, step 250, through communications link 16 to controller 35. Additional instrumentation may be provided, e.g. at vessel 1, to improve stability of the signal generated by sensor 14.

Controller 35 uses, step 260, the generated signal, in part, in controlling controllable winch 30, e.g. controllable winch 30 changes its operation in response to a control signal issued by controller 35 in response to the signal received from sensor 14.

For example, controller 35 may control controllable winch 30 by rotating controllable winch 30 in a predetermined direction to compensate for changes in the desired predetermined parameter of the body of water in response to the received control signal, e.g. as pressure increases, winch drum 32 may take in cable and, as pressure decreases, winch drum 32 may pay out cable.

The ability of sensor 14 to generate its signal may be selectively enabled or disabled. For example, an operator of controllable winch 30 may wish to manually override or otherwise manually control operation of controllable winch 30, in whole or in part. Additionally, the operator may wish to have pressure motion compensation only at an intermediate work site or on demand.

In an alternative embodiment, a manually controllable signal offset may be provided to allow load 20 to be maneuvered along a predetermined axis while maintaining stability of load 20 with respect a predetermined plane relative to underwater structure 55,56, e.g. a sea floor. For example, an operator may wish to provide a signal offset to allow load 20 to be raised or lowered at will while still maintaining vertical motion stability of load 20 relative to underwater structure 55,56.

In this manner, load 20 is controllably placed onto or proximate underwater structure 55,56. The signal received from sensor 14 may therefore be useful in determining movement about and/or a displacement in a desired plane, e.g. vertical displacement with respect to underwater structure 55,56, an underwater floor, vessel 1, or the like, or a combination thereof. Once load 20 has been placed onto or proximate underwater structure 55,56, an operator, such as on vessel 1, may opt to override the signal from sensor 14, e.g. lower slack in communication link 16 to facilitate removal of load bearing connection device 60 from load 20.

When load 20 has been positioned to its desired position, communications link 16 may be disconnected from load 20 such as by a diver, remotely operated vehicle, remote activated release device, or the like.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A system for determining movement of a load deployed by a movable vessel, comprising:

a. a sensor disposed proximate a load underwater, the sensor adapted to produce a transmittable signal indicative of a predetermined physical parameter usable to determine movement of the load underwater;

b. a receiver, located on a movable vessel and capable of indicating the signal received from the sensor; and c. a communication link operatively linking the sensor to the receiver.

2. The system of claim 1, wherein:

a. the indicated signal is at least one of (i) a visible detectable indicator, (ii) an audibly detectable indicator, (iii) a tactily detectable indicator, and (iv) a machine detectable indicator.

3. The system of claim 1, wherein:

a. the communication link is an electro-mechanical umbilical.

4. The system of claim 1, further comprising:

a. a deployment frame about which the load is disposed, the deployment frame comprising at least one of (i) a frame, (ii) a cage, (iii) a platform, or (iv) a mechanical coupler.

5. The system of claim 1, wherein:

a. the signal received from the sensor is useful in determining vertical displacement of the load with respect to at least one of (i) an underwater structure, (ii) an underwater floor or (iii) the movable vessel.

6. The system of claim 1, wherein:

a. the sensor is at least one of (i) a pressure transducer and (ii) an altimeter.

7. The system of claim 1, wherein:

a. the predetermined physical parameter is at least one of (i) water pressure, (ii) relative distance from an underwater structure, or (iii) relative distance from the movable vessel.

8. A system for controlling placement of a load underwater proximate an underwater structure, comprising:

a. a sensor disposed proximate an underwater load, the sensor adapted to produce a transmittable signal indicative of a predetermined physical parameter;

b. a communication link operatively in communication with the sensor;

c. a controllable winch;

d. a controller, in communication with and operable to control the controllable winch, the controller further in communication with the sensor via the communication link, the controller further capable of utilizing the transmittable signal generated by the sensor to control the controllable winch.

9. The system of claim 8 wherein:

a. changes in the predetermined physical parameter are indicative of movement of the load underwater.

10. The system of claim 8 wherein:

a. the movement is a vertical movement of the load with respect to at least one of (i) an underwater structure, (ii) an underwater floor, or (iii) a movable vessel.

11. The system of claim 8, wherein:

a. the communication link is operatively connected to the controllable winch, the communication link further being adapted to support the load during deployment of the load.

12. The system of claim 8, wherein:

a. the communication link is an electro-mechanical umbilical.

13. The system of claim 8, wherein the controllable winch further comprises:

a. a rotatable winch drum; and b. a winch slip ring assembly operatively connected to the rotatable winch drum and capable of providing signal transmission from a stationary to a rotary medium.

14. The system of claim 8, wherein the controller further comprises:

a. a computer operatively interposed in-between the controllable winch and the sensor, the computer adapted to:

i. receive the signal generated by the sensor; and ii. translate the received signal into a control signal for controlling the winch.

15. A method of controllably placing a load deployable by a movable vessel to a desired position with respect to an underwater structure, comprising:

a. disposing a sensor proximate a load;

b. deploying the load and the sensor underwater;

c. generating a signal with the sensor, the signal reflecting a detected predetermined physical parameter, the predetermined physical parameter comprising pressure;

d. communicating the generated signal through a communications link to a receiver;

e. indicating detected pressure at the receiver; and f. controlling a controllable winch in response to the indicated detected pressure to effect placement of the load proximate a structure underwater.

16. A method according to claim 15, wherein:

a. controlling the controllable winch further comprises rotating the controllable winch in a predetermined direction to compensate for changes in the received control signal.

17. A method according to claim 15, further comprising:

a. providing a manually controllable control signal offset to allow the load to be maneuvered along a predetermined axis while maintaining stability of the load with respect a predetermined plane relative to the underwater structure.

18. A method according to claim 17, wherein:

a. the underwater structure comprises at least one of (i) an underwater floor and (ii) a structure located at least partially at the underwater floor.

19. A method according to claim 15, further comprising:

a. selectively enabling and disabling the sensor.

20. A method of controllably placing a load deployable by a movable vessel to a position proximate an underwater structure, comprising:

a. securing a load about a deployment frame;

b. disposing a sensor proximate the load, the sensor adapted to detect a predetermined physical parameter;

c. connecting the deployment frame to a first end of a communication link, the communication link being capable of supporting the deployment frame and the load during deployment of the load underwater;

d. connecting a second end of the communication link to a controllable winch disposed about a movable vessel;

e. operatively connecting the sensor to the communication link;

f. deploying the deployment frame from the movable vessel into a body of water;

g. generating a signal with the sensor indicative of the predetermined physical parameter proximate the load;

h. sending the generated signal through the communications link to a controller; and i. controlling the controllable winch using the controller in response to a control signal issued by the controller at least partly in response to a received signal from the sensor to controllably position the load to a desired position proximate an underwater structure.

* * * * *